United States Patent [19]

Andersson

[11] Patent Number: 4,596,339

[45] Date of Patent: Jun. 24, 1986

[54] SEAL FOR SCREW CAPS

[76] Inventor: Ján R. Andersson, S-132 00, Saltsjö-Boo, Sweden

[21] Appl. No.: 694,006

[22] Filed: Jan. 23, 1985

[30] Foreign Application Priority Data

Jan. 30, 1984 [SE] Sweden ..... 8400456

[51] Int. Cl.[4] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 2,104,236 | 1/1938 | Mermer | 215/252 |
| 3,812,991 | 5/1974 | Wurl | 215/252 |
| 4,196,818 | 4/1980 | Brownbill | 215/252 |
| 4,529,096 | 7/1985 | Chartier et al. | 215/252 |

FOREIGN PATENT DOCUMENTS

| | | | |
|---|---|---|---|
| 651238 | 3/1951 | United Kingdom | 215/252 |

*Primary Examiner*—Donald F. Norton

*Attorney, Agent, or Firm*—Beveridge, DeGrandi & Weilacher

[57] ABSTRACT

A seal for screw caps for bottles or the like, including a breakable sealing ring on the screw cap adapted to engage a radially projecting collar on the bottle neck. The sealing ring consists of a number of peripherally separate flat or plate-like portions interconnected by means of bridge portions and is joined with the remaining part of the screw cap by means of tongues joining ends of the flat or plate-like portions adjacent the screw cap and the edge of said screw cap.

4 Claims, 2 Drawing Figures

SEAL FOR SCREW CAPS

Figure 1:
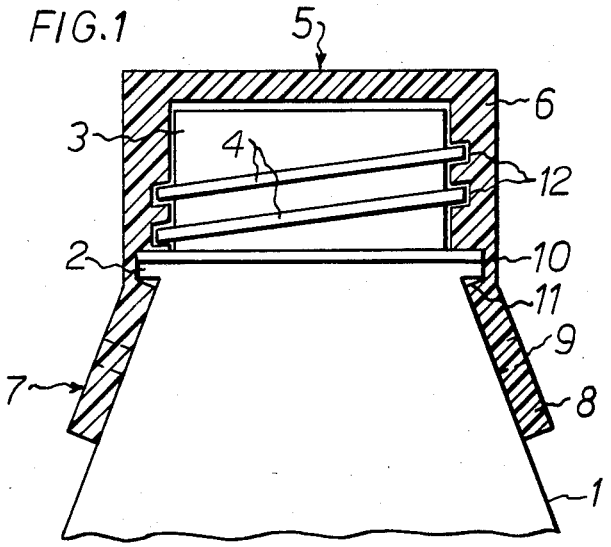

The present invention relates to a seal for screw caps for bottles, cans or other containers, including a breakable sealing ring arranged on the screw cap and adapted to engage in sealing position a radially projecting collar or the like arranged adjacent a threaded portion of the bottle or container neck, said sealing ring being adapted, as the cap is being unscrewed, to be deformed due to axial or peripheral breaks in the material, thus allowing removal of the cap.

It is previously known to provide screw caps in particular with a breakable seal so constructed that it will break the first time the cap is unscrewed, thus indicating that the cap has been opened.

In a prior art embodiment of such a seal the cap proper is provided with a ring-shaped portion projecting below the threaded cap portion and provided with internal inclined flaps and joined with the remaining part of the cap by means of weak material portions. The inclined flaps of the projecting portion are adapted to mesh with cog-shaped projections on the neck of the bottle or container, said flaps and cogs being arranged so as to allow screwing-on of the cap but to prevent turning of it in the opposite direction. To effect unscrewing of the collar the weak material portions must be torn off so that the cap is released from the portion provided with inclined flaps. When the top is unscrewed this portion will be left as a loose ring around the bottle neck and when the bottle is emptied, e.g. into the oil filling opening of a motor, it is apt to slide off, fall down in said opening and cause trouble.

In caps of metal there is often a ring which is situated below the threaded cap portion and which is joined to the cap by means of weak material portions and which, after the cap has been screwed on is pressed by means of a tool into engagement with a bead-like circumferential collar arranged below the threaded portion of the bottle or container neck. Also this ring is torn off and/or to pieces when the cap is unscrewed.

From a similar technical field, concerning safety seals for e.g. medicine bottles, there is known a cap arrangement including a number of internal recesses having finger-like projections arranged at the free lower edge of the cap, said recesses being adapted to embrace a bead-like collar arranged around the bottle neck. The fingers, which are separate from each other can be bent outwards individually when the lock is screwed on so that they can pass over the collar so far that this can be received in the recesses of the fingers when an external axially movable lock or latch ring is pressed against the outsides of the fingers and force the fingers inwards. The cap will thus be locked against unauthorized opening by, for instance, children, but is is not sealed in the full sense of this word.

The object of this invention is to provide a breakable seal for screw caps for bottles, cans and the like containers, said seal being constructed so as to be applicable with a minimum of resistance or, in other words only little force is required in addition to that which is necessary for screwing on the cover, and so constructed that the seal is distinctly detached when the cap is unscrewed, and thus indicates that the seal is broken, and is safely retained on the bottle or on the cap after removal of the cap.

The essential characteristic of the seal according to the invention is that a sealing ring consists of a number of peripherally separate flat or plate-like portions interconnected by means of bridge portions arranged along a zone situated between those ends of said portions which are situated adjacent and remotely from the screw cap, and that the peripherally coherent sealing ring consisting of said interconnected flat or plate-like portions is joined with the remaining part of the screw cap by means of tongues joining ends of that flat or plate-like portions adjacent the screw cap and the edge of said screw cap, said tongues having a smaller radial thickness than said portions and being outwardly off set from the inner end edges of the same portions and forming abutment means engaging the bottle neck collar.

Figure 2:
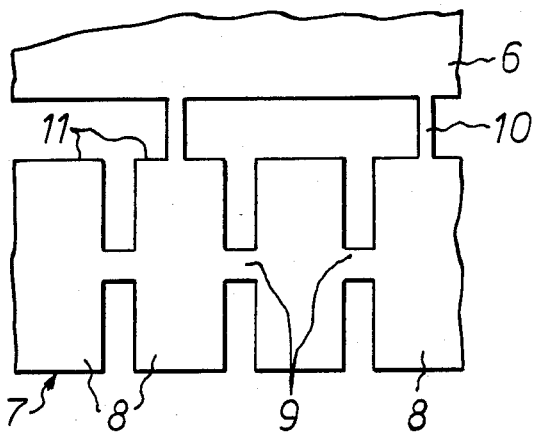

An embodiment of the seal according to the invention will be described more fully below with reference to the accompanying drawing in which:

FIG. 1 is a side view of the neck portion of a bottle or like container and an axial cross-section of a cap provided with the device according to the invention, and FIG. 2 is a side view of a broken-out portion of such a cap with the adjacent portion of the seal proper.

In the drawing, the neck portion of a bottle or like container is designated by 1. The bottle neck, which suitably is of conical shape with an angle between 5° and 75°, preferably between 20° and 40°, is provided with a projecting collar 2 adjacent the transition to the upper portion 3 provided with threading 4.

The cap 5 has a generally cylindrical portion 6 provided with an internal threading 12 complementary to threading 4. Arranged beyond the generally cylindrical portion 6 of the cap 5 is according to the invention a sealing ring, generally designated by 7, which consists of a number of substantially axially oriented flat or plate-like portions 8 which are interconnected by means of bridge portions 9 along a zone between their axially opposite ends.

Individual and separate such flat or plate-like portions are connected with the edge of the generally cylindrical portion 6 of the cap by means of tongues 10, the thickness of which is considerably less than that of said portions 8. Said tongues are also radially outwardly offset so that abutment edges 11 are formed at the upper ends of the flat portions 8.

The cap 5 and the sealing ring 7 are made in one piece of appropriate material, e.g. polyethylene, PVC, acryl, polypropylene or the like, but the sealing ring possesses great mobility relative to the cap due to the fact that the ring is built up of several portions interconnected along a central zone and the individual connecting tongues.

When a cap provided with a sealing means is screwed on a bottle or the like the flat or plate-like portions 8 of the sealing ring will be turned outwards when meeting the collar 2 and, after having passed the collar they will snap inwards so that the abutment edges 11 will engage the radial underside of the collar 2. The flat or plate-like portions 8 will thereupon, as shown in the drawing, adjoin the outside of the bottle neck and when the cap is further tightened the abutment edges may also be slightly removed from the collar.

The abutment edges 11 constitute a bar to unscrewing the cap and the cap cannot be unscrewed until the unscrewing force will be so heavy that the material breaks in either the tongues 10 or in the bridge portions 9. Which material is to burst in the first place is determined by the choice of material and the dimensioning of the tongues 10 and the bridge portions 9.

In case it is desired to allow the sealing ring to remain on the bottle or the like the tongues 10 are made weaker than the bridge portions 9. In that case the tongues will burst due to axial stress and free the cap from the sealing ring. In case it is desired—in order to enable reuse—to free the bottle or the container also from the sealing ring in connection with removal of the cap, the bridge portions 9 are made weaker and the tongues 10 stronger. When the cap is unscrewed the portions 8 will tend to turn obliquely outwardly as a result of the leverage arising due to the radial outward displacement of the tongues 10. When the force turning the portions 8 outwardly will be sufficiently heavy the bridge portions 9 will burst so that the flat or plate-like portions 8 move outwards and release their engagement with the collar 4. The unscrewed cap will than have a number of remaining radiantly projecting portions 8.

Irrespective of embodiment chosen there is obtained a marked break of the seal and a distinctly checked retaining of the sealing ring or the rest thereof in the manner desired.

What I claim and desire to secure by Letters Patent is:

1. A screw cap with sealing device for bottles, cans or other containers, including a breakable sealing ring (7) arranged on the screw cap (5) and adapted to engage in sealing position a radially projecting collar or the like (2) arranged adjacent a threaded portion of the bottle or container neck, said sealing ring being adapted, as the cap is being unscrewed, to be deformed due to peripheral breaks in the material, thus allowing removal of the cap, wherein the sealing ring (7) consists of a number of peripherally separate plate-like portions (8) interconnected by means of bridge portions (9) arranged along a zone situated between those ends of said portions which are situated adjacent and remotely from the screw cap, said sealing ring (7) being joined to the screw cap (5) by means of tongues (10) joining ends of the plate-like portions adjacent the screw cap and the edge of said screw cap, said tongues having a smaller radial thickness than said plate-like portions and being outwardly offset from the inner end edges of said portions, said inner end edges forming abutment means engaging the bottle neck collar.

2. The screw cap as claimed in claim 1, wherein the tongues (10) connectig the selaing ring (7) with the cap edge are weaker than the bridge portions (9) and are adpated to burst when the cap is unscrewed before the bridge portions between the plate-like portions (8) of the sealing ring.

3. The screw cap as claimed in claim 2, wherein the bridge portions (9) connecting the plate-like portions (8) of the sealing ring (7) are weaker than the tongues (10) and are adapted to burst before the tongues (10) connecting the sealing ring with the cap.

4. The screw cap as claimed in claim 1, wherein the number of connecting tongues (10) is less than the number of plate-like portions.

* * * * *